US007997954B2

(12) United States Patent
Kobayashi

(10) Patent No.: US 7,997,954 B2
(45) Date of Patent: Aug. 16, 2011

(54) CENTERLESS GRINDING METHOD

(75) Inventor: Satoshi Kobayashi, Yamagata (JP)

(73) Assignee: Micron Machinery Co., Ltd., Yamagata-shi (JP)

( * ) Notice: Subject to any disclaimer, the term of this patent is extended or adjusted under 35 U.S.C. 154(b) by 625 days.

(21) Appl. No.: 12/160,435

(22) PCT Filed: Apr. 16, 2008

(86) PCT No.: PCT/JP2008/000996

§ 371 (c)(1),
(2), (4) Date: Jul. 10, 2008

(87) PCT Pub. No.: WO2009/072224

PCT Pub. Date: Jun. 11, 2009

(65) Prior Publication Data

US 2010/0173571 A1 Jul. 8, 2010

(30) Foreign Application Priority Data

Dec. 3, 2007 (JP) ..... 2007-312396

(51) Int. Cl.
*B24B 49/00* (2006.01)
*B24B 1/00* (2006.01)

(52) U.S. Cl. ..... 451/11; 451/49; 451/241; 451/242; 451/243

(58) Field of Classification Search ..... 451/9, 10, 451/11, 49, 51, 241, 242, 243
See application file for complete search history.

(56) References Cited

U.S. PATENT DOCUMENTS

| | | | | |
|---|---|---|---|---|
| 4,083,151 | A * | 4/1978 | Jessup et al. | 451/242 |
| 4,150,955 | A * | 4/1979 | Samuelson | 51/298 |
| 4,570,387 | A * | 2/1986 | Unno et al. | 451/5 |
| 5,567,195 | A * | 10/1996 | Tufts et al. | 451/11 |
| 5,643,051 | A * | 7/1997 | Zhou et al. | 451/11 |
| 5,746,644 | A * | 5/1998 | Cheetham | 451/6 |
| 5,928,065 | A * | 7/1999 | Shih | 451/72 |
| 6,312,318 | B1 * | 11/2001 | Mushardt et al. | 451/49 |
| 2004/0209558 | A1 * | 10/2004 | Junker | 451/249 |
| 2010/0035517 | A1 * | 2/2010 | Hall et al. | 451/5 |

FOREIGN PATENT DOCUMENTS

JP 56 27766 3/1981

(Continued)

*Primary Examiner* — Eileen P. Morgan
(74) *Attorney, Agent, or Firm* — Oblon, Spivak, McClelland, Maier & Neustadt, L.L.P.

(57) ABSTRACT

To provide a centerless grinding method which facilitates a tooling change and enables automation. A blade 11 is disposed slidable along a first straight line 101, i.e., Y axis, a grinding wheel 7 is disposed slidable along a second straight line 102, i.e., X axis, and a regulating wheel 9 is disposed slidable along a third straight line 103 intersecting with the second straight line at an angle θ2. At a tooling change, then, the blade is moved in a negative direction of the Y axis with an increase in diameter of a workpiece, the grinding wheel is moved in a negative direction of the X axis with an increase in diameter of the workpiece, and the regulating wheel is moved in a positive direction of the Y axis and also in a positive direction of the X axis with an increase in diameter of the workpiece. With this, angles α and β, which a contact angular position reference line S makes with line segments OB and OR, are made always constant.

2 Claims, 5 Drawing Sheets

FOREIGN PATENT DOCUMENTS

| | | |
|---|---|---|
| JP | 60 25640 | 2/1985 |
| JP | 5 285811 | 11/1993 |
| JP | 6 246608 | 9/1994 |
| JP | 8 19944 | 1/1996 |
| JP | 2004 136391 | 5/2004 |

* cited by examiner

CENTERLESS GRINDING METHOD

TECHNICAL FIELD

The present invention relates to a centerless grinding method.

BACKGROUND ART

A centerless grinding method is a grinding method in which grinding is performed with a workpiece being rotatably supported not at its center but through contact with three members, i.e., a grinding wheel, a regulating wheel, and a blade (see Patent Document 1).

Also as a workpiece feeding method, there is known a throughfeed method, and this method is a highly efficient in mass production, wherein grinding is performed such that a workpiece is advanced virtually along direction of the rotational axis of a wheel and passed through a space between two wheels with the regulating wheel given a slight feed angle. In order to properly feed and eject a workpiece into and from a space between the two wheels, as described above, there is also provided a guide plate for guiding movement of the workpiece.

Patent Document 1: Japanese Unexamined Patent Application Publication No. 2004-136391

DISCLOSURE OF THE INVENTION

Problems to be Solved by the Invention

Heretofore, whenever processing workpieces of various sizes by centerless grinding, it has been required to perform a tooling change, i.e., to adjust the position of the regulating wheel with respect to the grinding wheel and also adjust the position and posture of the blade and the guide plate accordingly. However, such a tooling change requires a lot of skill and also a lot of time and effort, causing the problems of a decrease in efficiency and an increase in cost.

The present invention has been devised in view of the foregoing problems and has an object to provide a centerless grinding method which facilitates a tooling change and enables automation.

Means for Solving the Problems

In order to solve the above problems, the present invention provides a centerless grinding method in which Y and X axes, which are perpendicular to each other in a plane perpendicular to a rotational axis of a workpiece, are designated first and second straight lines, respectively, the method comprising:

disposing a blade that is slidable along the first straight line;

disposing a grinding wheel that is slidable along the second straight line; and disposing a regulating wheel that is slidable along a third straight line intersecting with the second straight line at an angle θ2, wherein at a tooling change, the blade moves in a negative direction of the Y axis with an increase in diameter of the workpiece, the grinding wheel moves in a negative direction of the X axis with an increase in diameter of the workpiece, the regulating wheel moves in a positive direction of the Y axis and also in a positive direction of the X axis with an increase in diameter of the workpiece, whereby when contacts of the workpiece with the blade and the regulating wheel are designated contacts B and R, respectively, a center of the workpiece is designated center O, and a line passing through the center O and extending parallel with the Y axis is designated contact angular position reference line S, the tooling change along with a change in diameter of the workpiece is performed such that angles α and β of the contact angular position reference line S with line segments OB and OR are always constant (α, β<180 degrees).

In order to solve the same problems, the present invention provides another centerless grinding method in which Y and X axes, which are perpendicular to each other in a plane perpendicular to a rotational axis of a workpiece, are designated first and second straight lines, respectively, the method comprising:

disposing a blade that is slidable along the first straight line;

disposing a grinding wheel that is slidable along the second straight line; and disposing a regulating wheel that is slidable along a third straight line intersecting with the second straight line at an angle θ3, wherein at a tooling change, the blade moves in a negative direction of the Y axis with an increase in diameter of the workpiece, the grinding wheel moves in a negative direction of the X axis with an increase in diameter of the workpiece, the regulating wheel moves in the negative direction of the Y axis and also in a positive direction of the X axis with an increase in diameter of the workpiece, whereby when contacts of the workpiece with the blade, the regulating wheel, and the grinding wheel are designated contacts B, R, and G, respectively, a center of the workpiece is designated center O, and a line passing through the center O and extending parallel with the Y axis is designated contact angular position reference line S, the tooling change along with a change in diameter of the workpiece is performed such that angles α, β, and γ of the contact angular position reference line S with line segments OB, OR, and OG are always constant (α, β, γ<180 degrees).

Effects of the Invention

According to the above-described invention, it is possible to suppress a decrease in efficiency and an increase in cost due to a tooling change and also to handle workpieces of various sizes including a workpiece of an extremely large diameter. In addition, a tooling change can be automated for such workpieces of various sizes including a workpiece of an extremely large diameter in such a manner that the blade, the grinding wheel, and the regulating wheel are each moved by a servomotor and the operation amount of each servomotor is arithmetically controlled.

Other features of the present invention and effects therefrom will be described in detail with reference to the embodiments and the accompanying drawings.

EXPLANATION OF THE SYMBOLS

Figure 1:
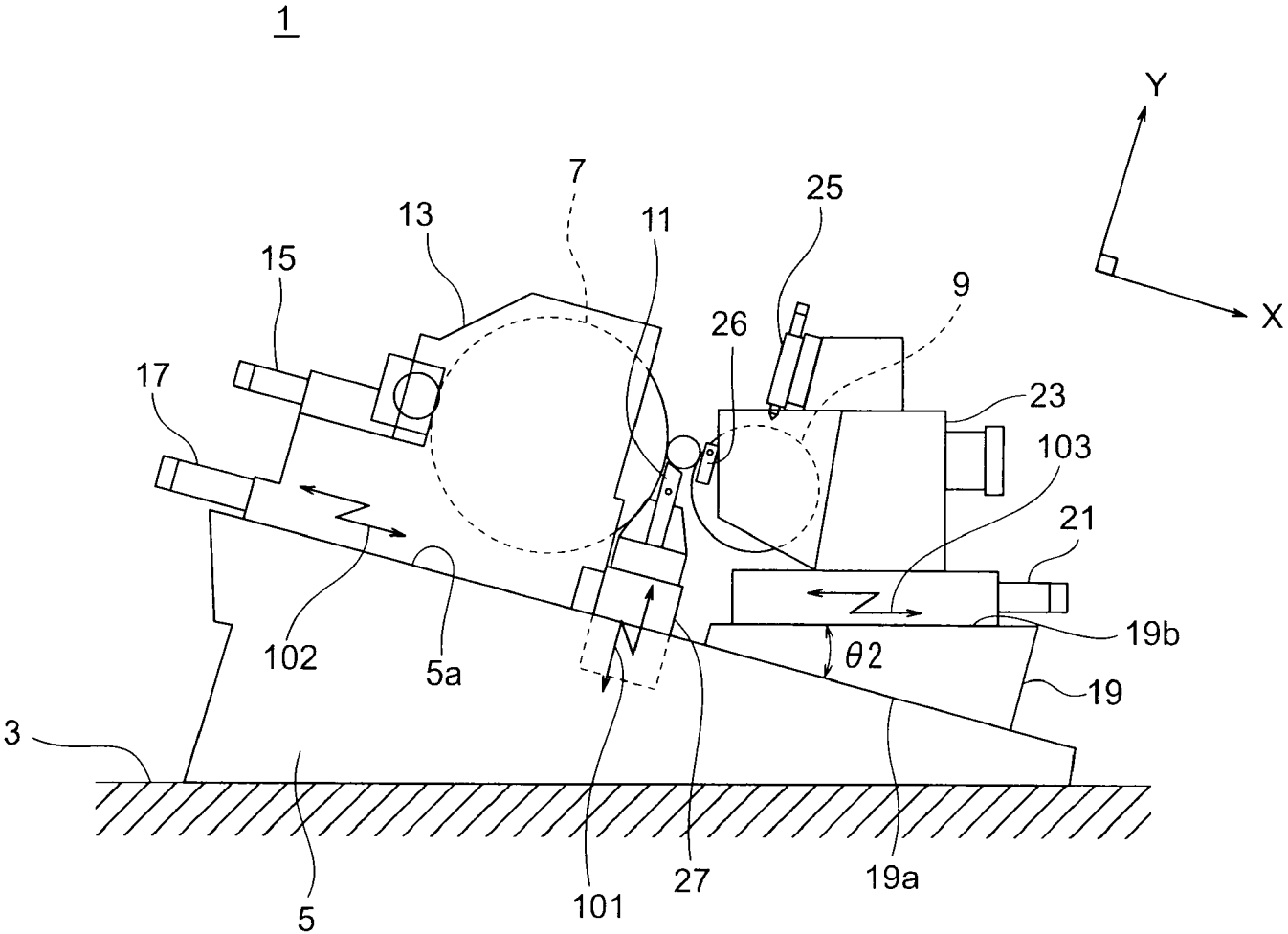
FIG. 1 is a diagram showing a configuration of a centerless grinding device for implementing a centerless grinding method according to the present invention.

1 Centerless Grinding Device
7 Grinding Wheel
9 Regulating Wheel
11 Blade
101 First Straight Line
102 Second Straight Line
103 Third Straight Line

BEST MODE FOR IMPLEMENTING THE INVENTION

Hereinbelow embodiments of the present invention will be described with reference to the accompanying drawings. It should be noted that in the drawings, the same or corresponding portions are designated by a common symbol.

First Embodiment

First, FIG. 1 shows a configuration of a centerless grinding device for implementing a centerless grinding method according to one embodiment. A centerless grinding device 1 has a bed 5 secured on a device-mounting surface 3.

Above a support surface 5*a* of the bed 5, there are disposed a grinding wheel 7, a regulating wheel 9, and a blade 11. The grinding wheel 7 is rotatably supported by a grinding wheel-driving system 13 mounted on the support surface 5*a*. In the vicinity of the grinding wheel 7, there are also disposed a grinding wheel-dressing system 15 and a grinding wheel-sliding system 17.

The regulating wheel 9 is disposed opposed to the grinding wheel 7 and rotatably supported by a regulating wheel-driving system 23 that is disposed above the support surface 5*a* through a lower sliding table 19 and an upper sliding system 21. In the vicinity of the regulating wheel 9, there is disposed a regulating wheel-dressing system 25. Moreover, guide plates 26 are disposed on workpiece-feeding and ejecting sides of the regulating wheel 9. When feeding and ejecting a workpiece, the workpiece is fed into a space between the grinding wheel 7 and the regulating wheel 9 while being kept in contact with and supported by the guide plate 26, so that three contacts of the workpiece with the grinding wheel 7, the regulating wheel 9, and the blade 11 can be appropriately positioned to achieve desired grinding results. It should be noted that the workpiece-feeding side corresponds to a front surface of the paper of FIG. 1.

Between the grinding wheel 7 and the regulating wheel 9, there is disposed the blade 11. The blade 11 is supported slidable in a given direction through a blade-sliding system 27 mounted on the support surface 5*a*.

Next will be described movement of the individual wheels and the blade. In FIG. 1, the plane of paper is a plane perpendicular to a rotational axis of a workpiece, and in this plane, Y and X axes, which are perpendicular to each other, are set for the sake of convenience. The X axis is a line parallel to the support surface 5*a* of the bed 5, and consequently, the Y axis is a line perpendicular thereto. Concerning positive and negative directions of the X axis based on a positional relationship between the grinding wheel 7 and the regulating wheel 9, the positive direction refers to a side closer to the regulating wheel 9 with respect to the grinding wheel 7. Concerning positive and negative directions of the Y axis based on a positional relationship between the blade 11 and the bed 5, the positive direction refers to a side closer to the blade 11 with respect to the bed 5. As understood from the description hereinafter, since each of the Y and X axes has a meaning in its extension direction and its positive and negative directions but does not have any meaning in its X and Y coordinates, the origin being an intersection of the Y and X axes will not be specifically mentioned.

To explain movement of the blade 11 based on the above premise, the blade 11 is disposed slidable along a first straight line 101, i.e., the Y axis, through the blade-sliding system 27. Next will be explained movement of the grinding wheel 7. The grinding wheel 7 is disposed slidable along a second straight line 102, i.e., the X axis, through the grinding wheel-sliding system 17. Further will be explained movement of the regulating wheel 9. The lower sliding table 19 is a portion having a generally wedge-like shape in the paper of FIG. 1 and provided with a lower surface 19*a* in contact with the support surface 5*a* of the bed 5 and an upper surface 19*b* mounted with the upper sliding system 21. The angle made between the lower surface 19*a* and the upper surface 19*b* is designated angle θ2. Thus, the regulating wheel 9 is disposed slidable along a third straight line 103, which intersects with the second straight line 102, i.e., the X axis, at an angle θ2, through the upper sliding system 21.

Then, a centerless grinding method according to the present embodiment using the centerless grinding device with the above configuration will be described with reference to FIG. 2. As a workpiece feeding method, there is adopted a throughfeed method. The workpiece is fed from the near side in the paper of FIG. 2 into a space between the grinding wheel 7, the regulating wheel 9, and the blade 11 while being guided by the guide plate 26, advanced to pass through the space, and ejected through the space from the remote side in the paper of FIG. 2 while being guided by a guide plate similar to that on the near side. Thus, grinding can be efficiently performed by continuously feeding, passing, and ejecting a plurality of workpieces with the guide plates 26.

In the centerless grinding, moreover, if the contact between the workpiece and the regulating wheel moves due to a tooling change, the guide plate has to be adjusted accordingly. If the contact between the workpiece and the blade moves, similarly, the height of the blade has to be adjusted. According to the present invention, however, the necessity of adjusting individual parts along with a tooling change is eliminated as described hereinbelow.

When proceeding to grind another workpiece of a different diameter, the tooling change is performed as follows. In the tooling change, generally, the blade 11 is moved in the negative direction of the Y axis along the first straight line 101 with an increase in diameter of the workpiece, the grinding wheel 7 is moved in the negative direction of the X axis along the second straight line 102 with an increase in diameter of the workpiece, and the regulating wheel 9 is moved in the positive direction of the Y axis and also in the positive direction of the X axis along the third straight line 103 with an increase in diameter of the workpiece.

Figure 2:
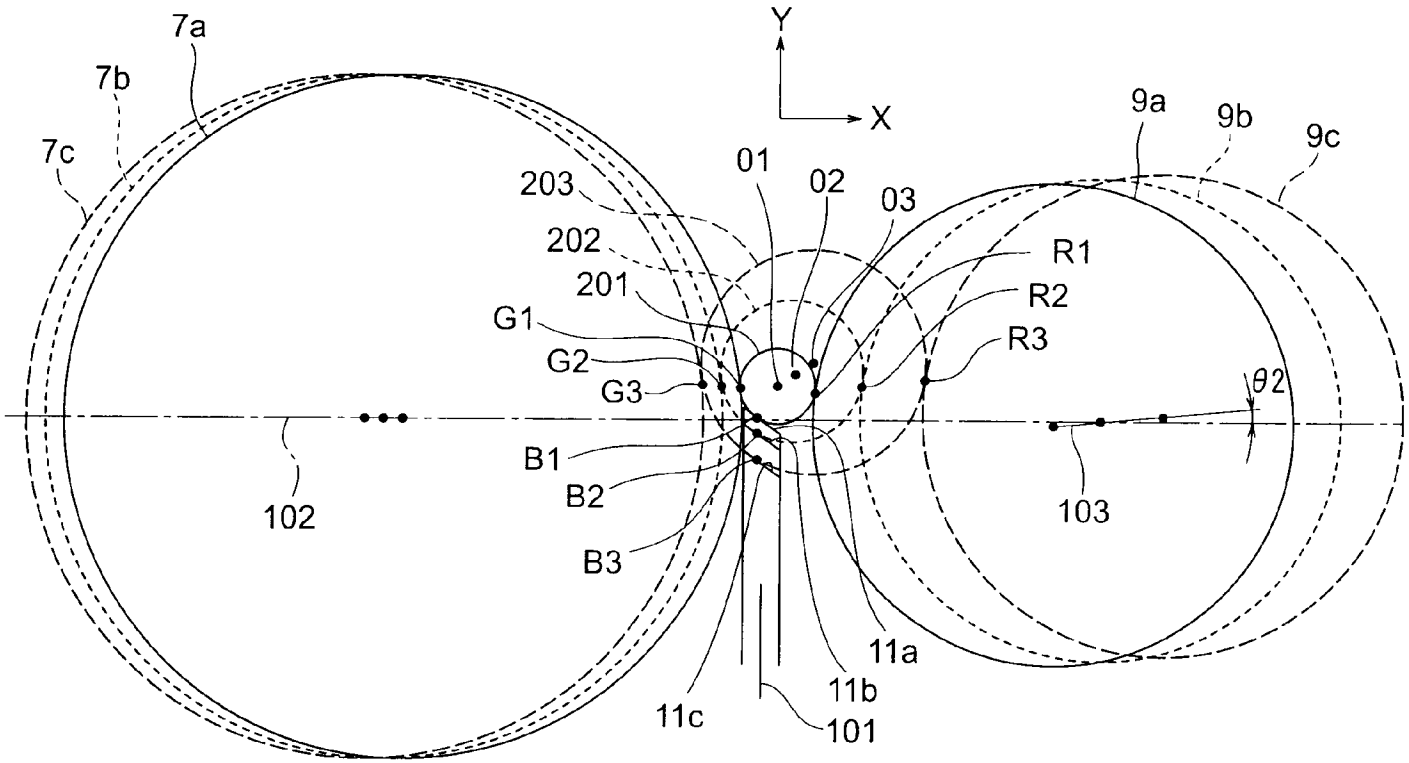
FIG. 2 is a diagram showing a centerless grinding method according to a first embodiment.

Concretely, when an object to be ground is changed from a workpiece 201 to a workpiece 202 with a larger diameter, the blade 11 is moved to descend downward in the paper of FIG. 2 from symbol 11*a* to symbol 11*b*, the grinding wheel 7 is moved leftward in the paper of FIG. 2 from symbol 7*a* to symbol 7*b*, and the regulating wheel 9 is moved rightward and slightly obliquely upward in the paper of FIG. 2 from symbol 9*a* to symbol 9*b*. Also when changed from the above workpiece 202 to a workpiece 203 with a much larger diameter, the blade 11 is moved to descend farther downward in the paper of FIG. 2 from symbol 11*b* to symbol 11*c*, the grinding wheel 7 is moved farther leftward in the paper of FIG. 2 from symbol 7*b* to symbol 7*c*, and the regulating wheel 9 is moved farther rightward and slightly obliquely upward in the paper of FIG. 2 from symbol 9*b* to symbol 9*c*. When an object to be ground is changed to a workpiece with a smaller diameter, on the other hand, the blade 11, the grinding wheel 7, and the regulating wheel 9 are moved in opposite directions from those described above, respectively.

Figure 3:
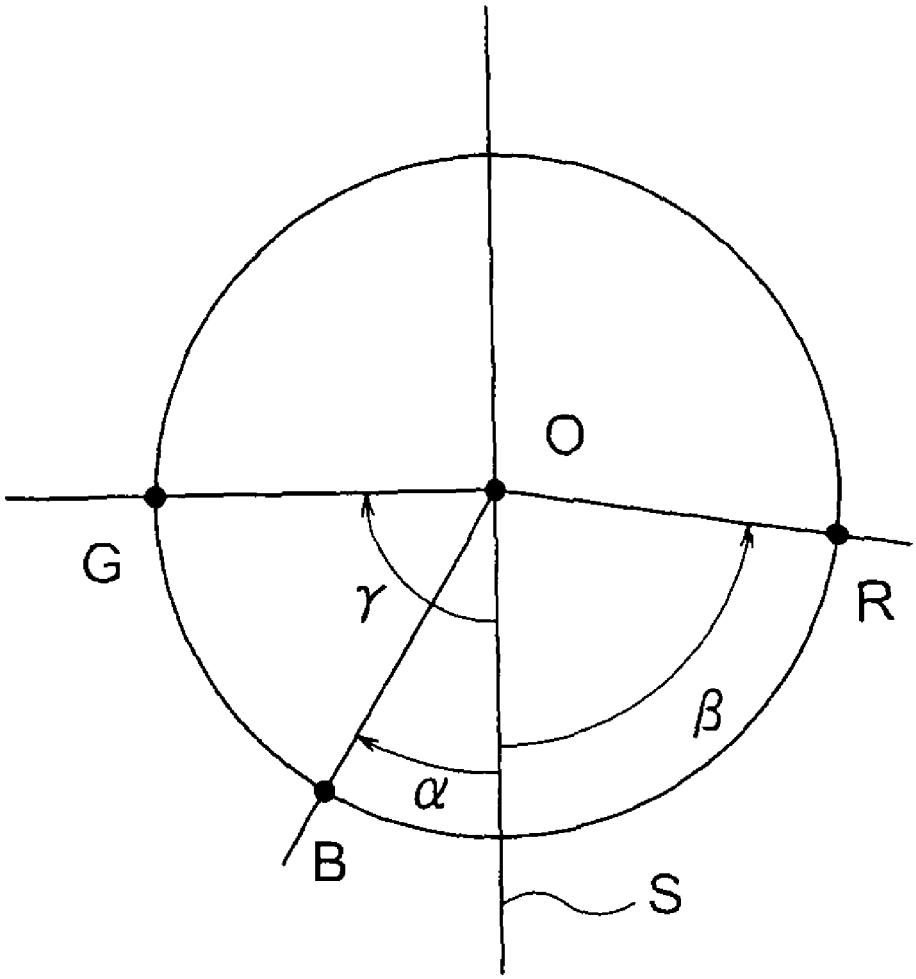
FIG. 3 is a diagram showing an aspect specifying the positions of three contacts of a workpiece with respect to a contact angular position reference line.

When the tooling change is thus performed, although the workpieces have varying diameters, proportionally the same positions of the workpieces serve as contacts with the blade 11 and the regulating wheel 9. That is, as shown in FIG. 3, when the contacts of the workpiece with the blade and the regulating wheel are designated contacts B and R, respectively, the center of the workpiece is designated center O, and the line passing through the center O and extending parallel with the Y axis is designated contact angular position reference line S, the angles α and β of the contact angular position reference line S with the line segments OB and OR are always constant (α, β<180 degrees).

In FIG. 2, concretely, the angle between the line segment O1B1 and the contact angular position reference line S, the angle between the line segment O2B2 and the contact angular position reference line S, and the angle between the line segment O3B3 and the contact angular position reference line S are the angle α and equal to each other. Also, the angle between the line segment O1R1 and the contact angular position reference line S, the angle between the line segment O2R2 and the contact angular position reference line S, and the angle between the line segment O3R3 and the contact angular position reference line S are the angle β and equal to each other. That is, although the workpieces have varying diameters, the contact R always changes in position on a line parallel to the third straight line 103 and the contact B always changes in position on a line parallel to the first straight line 101. Accordingly, the contact R is always located in the same direction with respect to the rotational center of the regulating wheel 9, and therefore, the guide plate 26 disposed therewith can be located always at the same position of the regulating wheel 9. Thus, the guide plate 26 can be secured in such a manner as to be movable along with the regulating wheel 9, so that the necessity of adjusting the position and posture of the guide plate every time a tooling change is performed as in the prior art can be eliminated to thereby suppress a decrease in efficiency and an increase in cost due to a tooling change. This also reduces the time necessary to perform a tooling change. Particularly, large components such as the blade have been difficult to replace, but the present embodiment is significantly effective in reducing the working time since large components such as the blade do not have to be replaced.

In practice, moreover, the blade 11, the grinding wheel 7, and the regulating wheel 9 described above are each moved with a servomotor disposed in corresponding one of the driving or sliding system, wherein the operation amount of each servomotor is calculated and controlled. This enables automation of a tooling change for grinding a variety of workpieces as described above.

Figure 4:
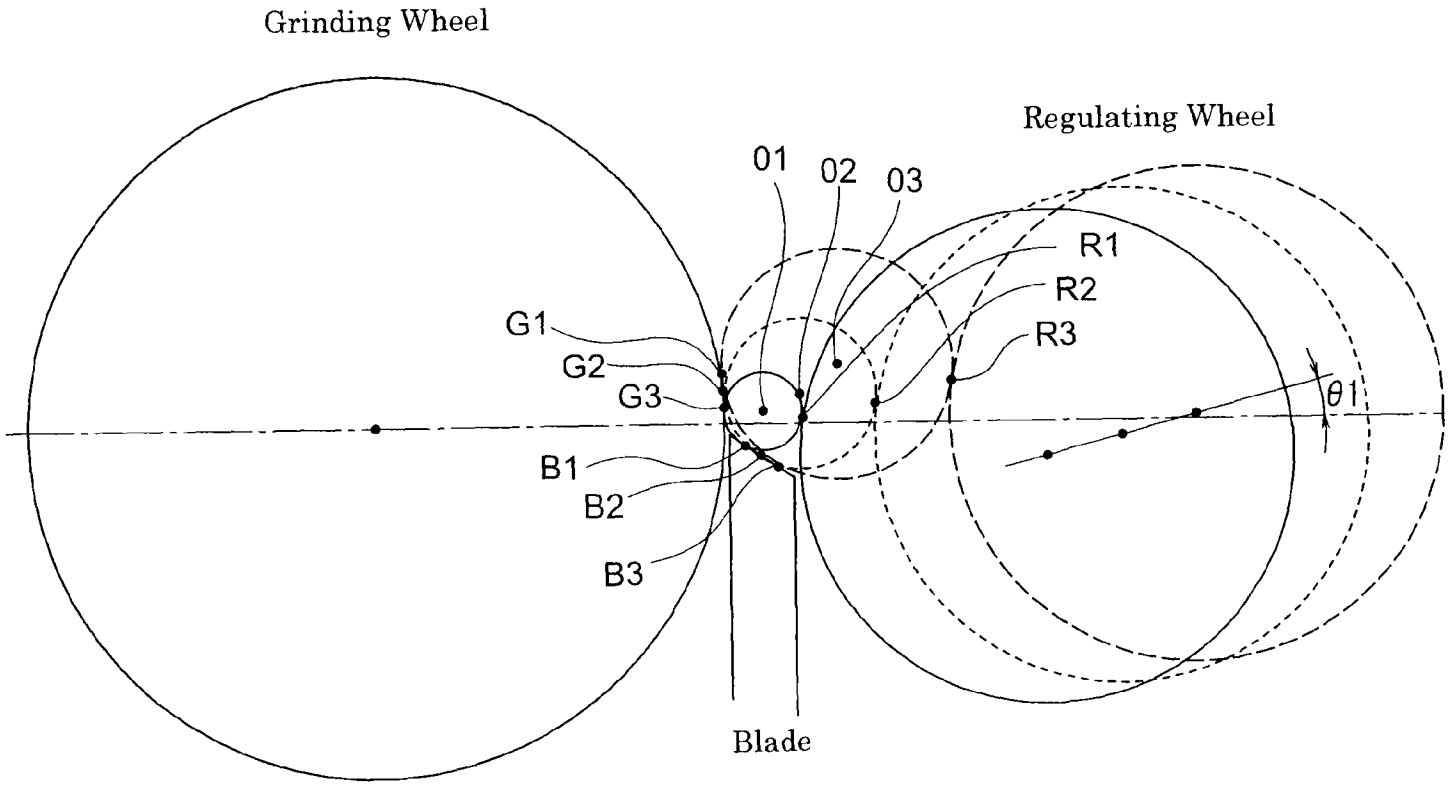
FIG. 4 is a diagram corresponding to FIG. 2 in which workpieces of different diameters are handled, by way of comparison, only by changing the position of a regulating wheel without moving a blade.

In the present embodiment, furthermore, since the contact B always changes in position on a line parallel to the first straight line 101, workpieces of various sizes including a workpiece of an extremely large diameter can be handled only by ascending and descending the blade without changing the blade itself. That is, when workpieces of different diameters are handled, by way of comparison, only by changing the position of the regulating wheel without moving the blade, as shown in FIG. 4, the contact R can always be located at the same position on the regulating wheel but the contact B cannot always be located at the same potion on the blade. Therefore, if the diameter of a workpiece to be ground exceeds a given value, there will be a case that the contact B cannot be located on the blade. According to the present embodiment, contrarily, since the contact B always changes in position on a line parallel to the first straight line 101, workpieces of various sizes including a workpiece of an extremely large diameter can be handled using a blade with a minimum thickness (dimension along the X axis).

Second Embodiment

Next will be described a centerless grinding method according to another embodiment of the present invention with reference to FIG. 5. In the second embodiment, the blade 11 is moved in the negative direction of the Y axis along the first straight line 101 with an increase in diameter of the workpiece, and the grinding wheel 7 is moved in the negative direction of the X axis along the second straight line 102 with an increase in diameter of the workpiece, as in the first embodiment. Moreover, the regulating wheel 9 is moved in the negative direction of the Y axis and also in the positive direction of the X axis along the third straight line 103 with an increase in diameter of the workpiece, unlike in the first embodiment. In the present embodiment, the third straight line 103 intersects with the second straight line 102, i.e., the Y axis, at an angle θ3.

Figure 5:
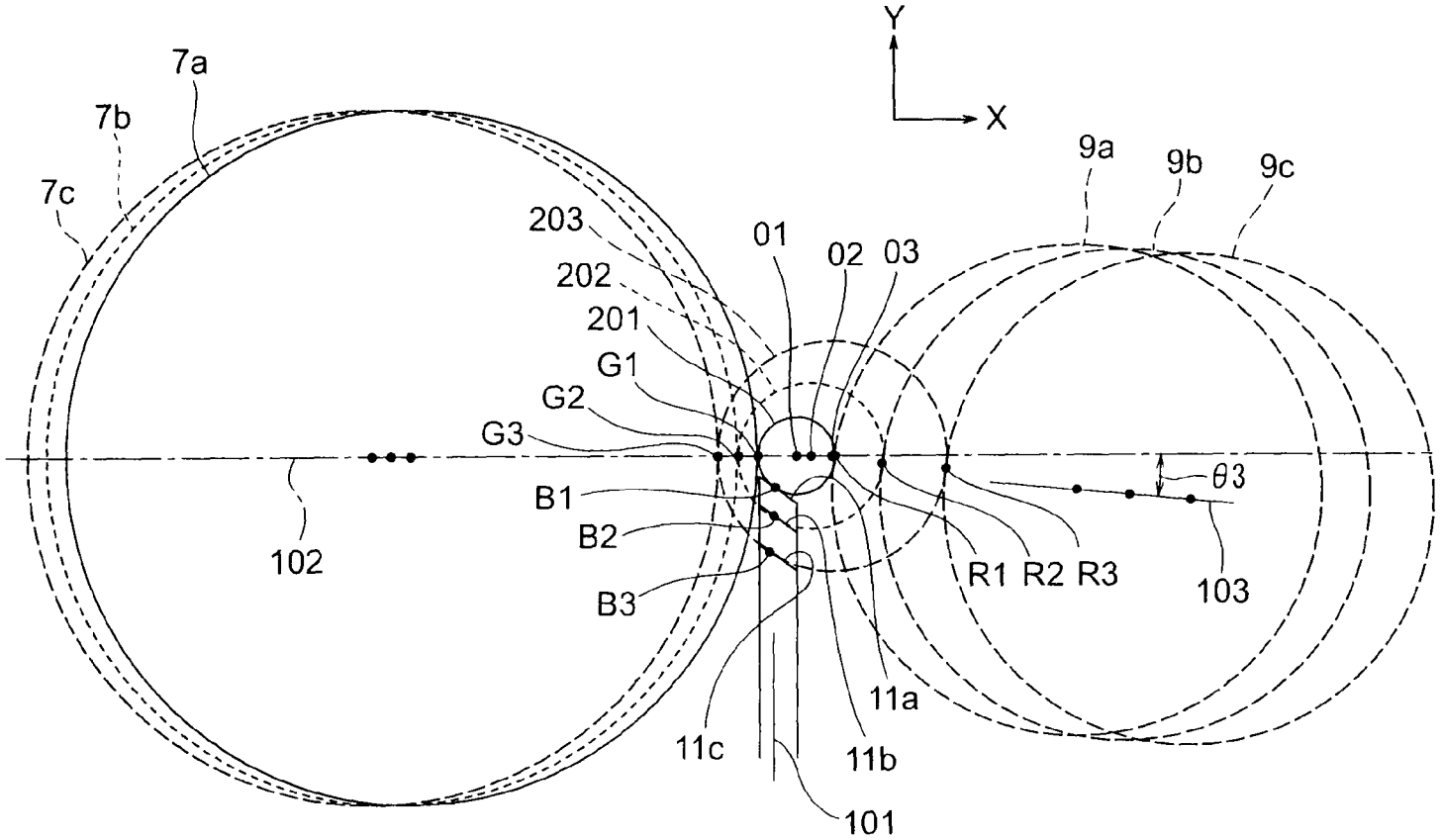
FIG. 5 is a diagram showing a centerless grinding method according to a second embodiment.

Concretely, when an object to be ground is changed from the workpiece 201 to the workpiece 202 with a larger diameter, the blade 11 is moved to descend downward in the paper of FIG. 5 from symbol 11*a* to symbol 11*b*, the grinding wheel 7 is moved leftward in the paper of FIG. 5 from symbol 7*a* to symbol 7*b*, and the regulating wheel 9 is moved rightward and slightly obliquely downward in the paper of FIG. 5 from symbol 9*a* to symbol 9*b*. Also when changed from the above workpiece 202 to the workpiece 203 with a much larger diameter, the blade 11 is moved to descend farther downward in the paper of FIG. 5 from symbol 11*b* to symbol 11*c*, the grinding wheel 7 is moved farther leftward in the paper of FIG. 5 from symbol 7*b* to symbol 7*c*, and the regulating wheel 9 is moved farther rightward and slightly obliquely downward in the paper of FIG. 5 from symbol 9*b* to symbol 9*c*. When an object to be ground is changed to a workpiece with a smaller diameter, on the other hand, the blade 11, the grinding wheel 7, and the regulating wheel 9 are moved in opposite directions from those described above, respectively.

When the tooling change is thus performed, although the workpieces have varying diameters, the angles α and β of the contact angular position reference line S with the line segments OB and OR are always constant (α, β<180 degrees) as in the first embodiment, and additionally in the present embodiment, when the contact of the workpiece with the grinding wheel is designated contact G, the angle γ of the contact angular position reference line S with the line segment OG is always constant, too (γ<180 degrees).

Accordingly, firstly, a decrease in efficiency and an increase in cost due to a tooling change can be suppressed by securing the guide plate in such a manner as to be movable along with the regulating wheel 9, as in the first embodiment. Moreover, if the blade is just made ascendable and descendable, workpieces of various sizes including a workpiece of an extremely large diameter can be handled using a blade with a minimum thickness.

In the present embodiment, furthermore, since not only the angles α and β but also the angle γ is always constant, when a solid (rod-like) workpiece is ground, an extremely high roundness can be maintained even through a tooling change. It should be noted that the second embodiment is not suitable for a ring-like workpiece that tends to bend along direction of its diameter since the optimum compound angle of the angles γ and β for maintaining processing accuracy at finishing tends to change with a change in diameter of the workpiece. In this case, it is preferably handled such that in the first embodiment, the angle θ2 is so set as to permit the compound angle of the angles γ and β to appropriately change in response to a change in diameter of the workpiece.

While the details of the present invention have been specifically described with reference to the preferred embodiments thereof, it will be understood by those skilled in the art that various changes in form may be made therein based on the basic technical idea and teaching of the present invention.

The invention claimed is:

1. A centerless grinding method in which Y and X axes, which are perpendicular to each other in a plane perpendicular to a rotational axis of a workpiece, are designated first and second straight lines, respectively, the method comprising:

disposing a blade that is slidable along said first straight line;

disposing a grinding wheel that is slidable along said second straight line; and disposing a regulating wheel that is slidable along a third straight line intersecting with said second straight line at an angle θ2, wherein at a tooling change, said blade moves in a negative direction of said Y axis with an increase in diameter of said workpiece, said grinding wheel moves in a negative direction of said X axis with an increase in diameter of said workpiece, said regulating wheel moves in a positive direction of said Y axis and also in a positive direction of said X axis with an increase in diameter of said workpiece, whereby when contacts of said workpiece with said blade and said regulating wheel are designated contacts B and R, respectively, a center of said workpiece is designated center O, and a line passing through said center O and extending parallel with said Y axis is designated contact angular position reference line S, said tooling change along with a change in diameter of said workpiece is performed such that angles α and β of said contact angular position reference line S with line segments OB and OR are always constant (α, β<180 degrees).

2. A centerless grinding method in which Y and X axes, which are perpendicular to each other in a plane perpendicular to a rotational axis of a workpiece, are designated first and second straight lines, respectively, the method comprising:

disposing a blade that is slidable along said first straight line;

disposing a grinding wheel that is slidable along said second straight line; and disposing a regulating wheel that is slidable along a third straight line intersecting with said second straight line at an angle θ3, wherein at a tooling change, said blade moves in a negative direction of said Y axis with an increase in diameter of said workpiece, said grinding wheel moves in a negative direction of said X axis with an increase in diameter of said workpiece, said regulating wheel moves in said negative direction of said Y axis and also in a positive direction of said X axis with an increase in diameter of said workpiece, whereby when contacts of said workpiece with said blade, said regulating wheel, and said grinding wheel are designated contacts B, R, and G, respectively, a center of said workpiece is designated center O, and a line passing through said center O and extending parallel with said Y axis is designated contact angular position reference line S, said tooling change along with a change in diameter of said workpiece is performed such that angles α, β, and γ of said contact angular position reference line S with line segments OB, OR, and OG are always constant (α, β, γ<180 degrees).

* * * * *